United States Patent [19]

Homma

[11] Patent Number: 4,872,036

[45] Date of Patent: Oct. 3, 1989

[54] DEVELOPING APPARATUS

[75] Inventor: Toru Homma, Sagamihara, Japan

[73] Assignee: Kabushiki Kaisha Toshiba, Kawasaki, Japan

[21] Appl. No.: 274,907

[22] Filed: Nov. 22, 1988

[30] Foreign Application Priority Data

Nov. 30, 1987 [JP] Japan ..... 62-302634

[51] Int. Cl.[4] ..... G03G 15/08

[52] U.S. Cl. ..... 355/253; 355/245; 355/251; 355/260; 355/262; 355/265

[58] Field of Search ..... 355/253, 251, 245, 260; 118/653, 657, 658; 430/120, 122

[56] References Cited

U.S. PATENT DOCUMENTS

| | | | |
|---|---|---|---|
| 4,580,888 | 4/1986 | Thompson et al. | 355/253 X |
| 4,598,991 | 7/1986 | Hosoya et al. | 355/262 X |
| 4,724,457 | 2/1988 | Abreu et al. | 355/253 |
| 4,804,995 | 2/1989 | Osawa et al. | 355/253 |

*Primary Examiner*—A. C. Prescott

*Attorney, Agent, or Firm*—Foley & Lardner, Schwartz, Jeffery, Schwaab, Mack, Blumenthal & Evans

[57] ABSTRACT

A developing apparatus for developing an electrostatic latent image on a photosensitive drum comprises upper and lower magnet rollers for supplying a toner to the latent image on the drum. Disposed in a void portion surrounded by the photosensitive drum and the upper and lower magnet rollers is a screening member for isolating the drum from those portions of the magnet rollers which face the void portion.

13 Claims, 2 Drawing Sheets

DEVELOPING APPARATUS

BACKGROUND OF THE INVENTION

1. Field of the Invention

The present invention relates to a developing apparatus adapted for use in an image forming apparatus, e.g., an electrophotographic optical printing machine.

In a conventional developing apparatus used in an image forming apparatus, such as an electrophotographic optical printing machine, a casing of a developing unit is provided with a plurality of developing rollers. In the developing apparatus of this type, the developing rollers are arranged along the rotating direction of a photosensitive drum, so that a developer is supplied in a plurality of steps to an electrostatic latent image formed on the drum. More specifically, each time the latent image on the drum faces a developing region of each developing roller, the developer is fed from the roller to the latent image.

Having the developing rollers arranged in this manner, the developing apparatus can enjoy a satisfactory developing characteristic, i.e., good image density. If n number of rollers are used in the developing apparatus, then the rotating speed of each developing roller, for a predetermined image density, must only be equal to about 1/n of that of a developing roller which is used singly in another developing apparatus. Thus, good image density can be obtained even with use of low-speed developing rollers. Moreover, the centrifugal force to act on a toner which adheres to each of the n developing rollers of the multi-roller developing apparatus is equal to $1/n^2$ of that for the case of the roller of the single-roller developing apparatus. Thus, the apparatus having two or more developing rollers has an advantage over the single-roller apparatus in being less liable to cause centrifugal scattering of the toner.

In the multi-roller developing apparatus described above, however, the profile of a void portion, which is surrounded by one developing roller (first developing roller), another developing roller (second developing roller) subsequent thereto, and the photosensitive drum, is widened sharply from the proximate portion between the rollers toward the drum. Therefore, some of convective air in the void portion stagnates, and toner cloud is produced at the stagnant region. As a result, the toner adheres to those portions of the electrostatic latent image which should not be coved with toner, thus fogging the resulting copy image.

SUMMARY OF THE INVENTION

The object of the present invention is to provide a developing apparatus capable of preventing a copy image from being fogged.

According to an aspect of the present invention, there is provided a developing apparatus which comprises first means for supplying a developing agent to a latent image on an image carrier, for developing the latent image, second means for supplying a developing agent to the latent image on the image carrier, for developing the latent image, and means, disposed in a region surrounded by the image carrier and the first and second means, for isolating the image carrier from those portions of the first and second means which face the surrounded region.

DETAILED DESCRIPTION OF THE PREFERRED EMBODIMENTS

An embodiment of the present invention will now be described in detail with reference to the accompanying drawings.

Figure 1:
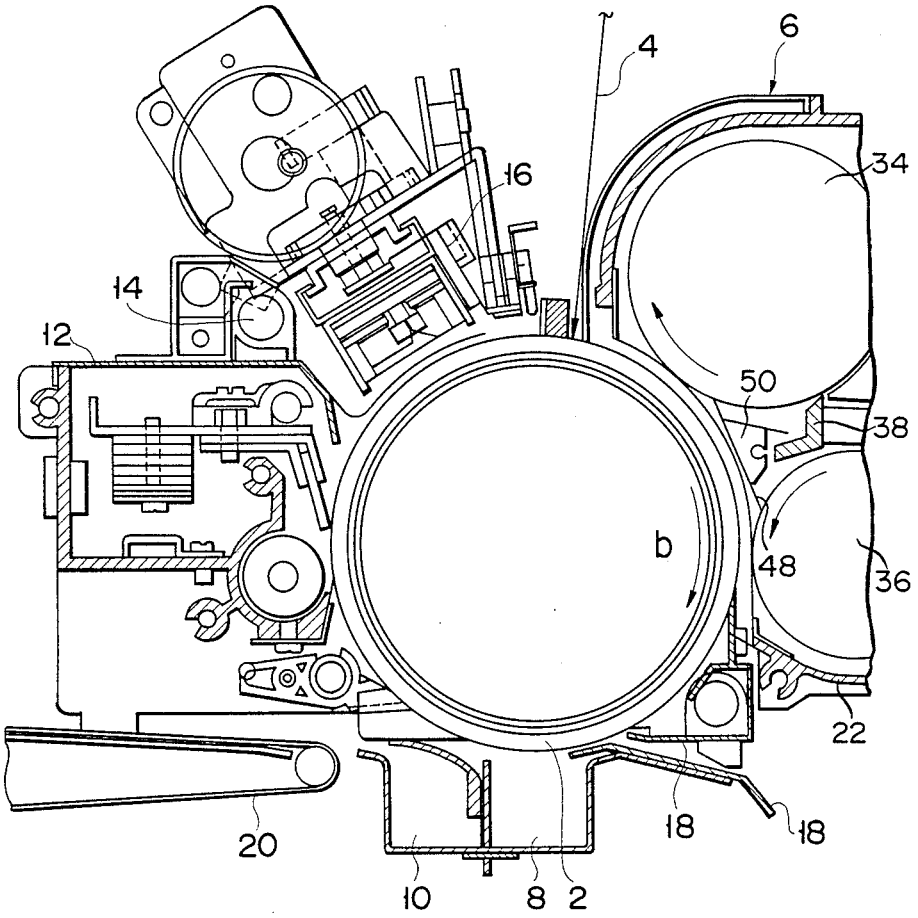
FIG. 1 is a sectional view showing part of an image forming apparatus using a developing apparatus according to the present invention.

In FIG. 1, numeral 2 denotes a photosensitive drum which is supported for rotation in the direction indicated by arrow b. The surface of drum 2 is exposed to light beam 4 from an exposure unit (not shown), the light beam carrying image information.

Developing unit 6, transfer charger 8, separation charger 10, cleaner 12, discharge lamp 14, and main charger 16 are arranged successively along the rotating direction of photosensitive drum 2, starting at the position for the exposure. Main charger 16 is used to charge the surface of drum 2 uniformly. Exposure unit 24 guides an optical image, which carries image information, to the charged surface of drum 2, thereby forming an electrostatic latent image on the drum surface. Developing unit 6 develops the latent image by means of toner T, thereby forming a toner image. Transfer charger 8 is used to transfer the toner image to the surface of a paper sheet. Separation charger 10 is used to separate the sheet from drum 2. Cleaner 12 serves to remove toner T remaining on drum 2. Discharge lamp 14 is used to erase a residual image on photosensitive drum 2, thereby lowering the potential on the drum to a predetermined level or below. Thus, the apparatus is ready for the next cycle of copying operation.

A pair of guide plates 18 are provided beside transfer charger 8. They guide the paper sheet, fed from a sheet feeder unit (not shown), toward a transfer section between photosensitive drum 2 and charger 8. Conveyor belt 20 is disposed beside separation charger 10. It transports the paper sheet to a fixing unit (not shown) when the sheet is separated from drum 2 by the agency of separation charger 10 after the toner image is transferred to the sheet by means of transfer charger 8. The fixing unit serves to fix the toner image to the sheet.

Figure 2:
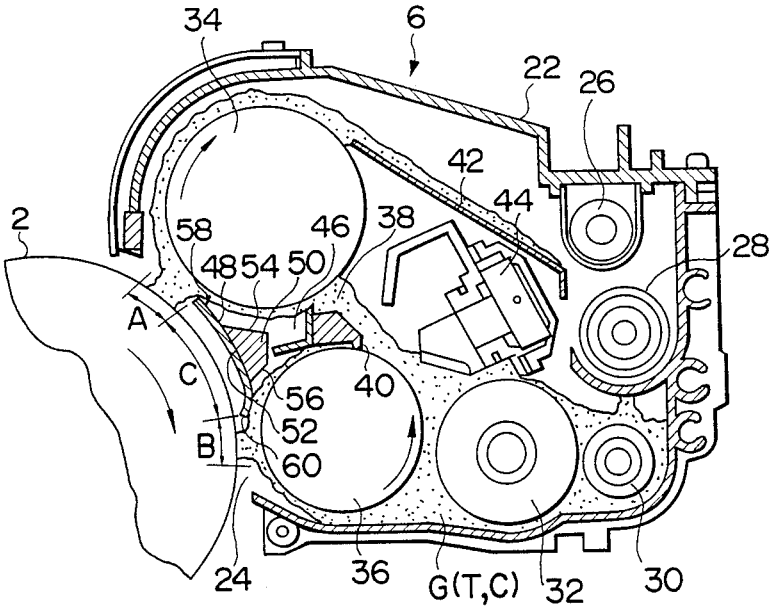
FIG. 2 is a sectional view of the developing apparatus according to the invention.

As shown in FIG. 2, developing unit 6 includes casing 22, which has opening 24 facing photosensitive drum 2. Casing 22 contains developer G, transportation auger 26, mixing auger 28, small- and large-diameter paddles 30 and 32, and upper and lower magnet rollers 34 and 36. The casing also houses upper and lower regulating members 38 and 40, scraper 42, and auto-toner sensor 44. Developer G is formed of toner T, a nonmagnetic substance, and carrier C, a magnetic substance. Transportation auger 26 is used to transport toner T from a toner resupply unit (not shown) in a direction parallel to the axis of drum 2. Mixing auger 28 is used to mix toner T, transported by auger 26, in developer G. Small-diameter paddle 30 is used to stir developer G which is formed of toner T and carrier C mixed by means of auger 28. Large-diameter paddle 32 is used further to stir developer G stirred by means of paddle 30. Rollers 34 and 36 serve to supply the electrostatic latent image on drum 2 with toner T in developer G stirred by means of paddle 32. Regulating members 38 and 40 serve to regulate the thickness of layers of developer G transported by means of rollers 34 and 36, respectively. Scraper 42 scrapes off some of developer G transported by means of upper magnet roller 34. Sensor 44 detects the concentration of developer G scraped by means of scraper 42. Upper magnet roller 34 feeds toner T to first developing region A of photosensitive drum 2, thereby developing the latent image on the drum. Lower magnet roller 36 feeds toner T to second developing region B of drum 2 on the lower-course side of region A, thereby developing the latent image on the drum.

Upper and lower regulating members 38 and 40 are located between upper and lower magnet rollers 34 and 36.

Upper magnet roller 34 rotates in the same direction as photosensitive drum 2, and lower magnet roller 36 rotates in the opposite direction. Thus, that portion of the surface of roller 34 which faces void portion 46 (mentioned later) moves from upper regulating member 38 toward drum 2, while that portion of the surface of roller 36 which faces void portion 46 moves from lower regulating member 40 toward drum 2.

Sheet-like screening member 48 and support member 50 for supporting the same are arranged in void portion 46, which is defined between photosensitive drum 2 and upper and lower magnet rollers 34 and 36. Support member 50 has first, second, and third faces 52, 54 and 56 which are opposed to drum 2, upper magnet roller 34, and lower magnet roller 36, respectively. Faces 52, 54 and 56 extend along the surfaces of drum 2, upper roller 34, and lower roller 36, respectively. Screening member 48 is fixed to first face 52 of support member 50 by, for example, adhesive bonding. It is situated so that rollers 34 and 36 are exposed to first and second developing regions A and B of photosensitive drum 2, and nondeveloping region C between regions A and B is screened from void portion 46. The screening member is formed of a material which cannot be negative at least against toner T, with respect to the charging system. The Young's modulus of screening member 48 ranges from 0.5 to 2.0 kg/mm$^2$, and its thickness ranges from 0.05 to 0.5 mm. Thus, member 48 is flexible. Upper end edge 58 of member 48 is softly in contact with developer G from upper magnet roller 34 without lowering the efficiency of transportation of the developer. Likewise, lower end edge 60 of member 48 is softly in contact with developer G from lower magnet roller 36 without lowering the transportation efficiency of the developer.

Figure 3:
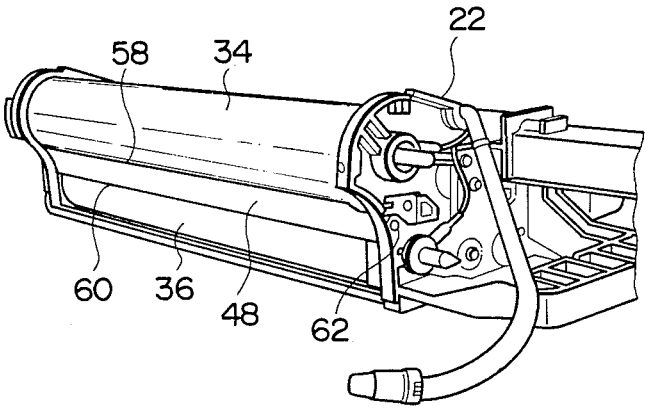
FIG. 3 is a perspective view of the developing apparatus shown in FIG. 2.

As shown in FIG. 3, screening member 48 is large enough to cover the whole range from the front side to the rear side of casing 22, that is, the whole transverse length of upper and lower magnet rollers 34 and 36. Support member 50 is fixed, at its front and rear sides, to the front and rear sides, respectively, of casing 22 by means of, e.g., screws 62.

After developer G, supplied to upper and lower magnet rollers 34 and 36, is regulated in layer thickness by means of upper and lower regulating members 38 and 40, it is transported past void portion 46 toward developing regions A and B. In this case, support member 50 is disposed in void portion 46, so that toner cloud, which may be caused by stagnation of convection can be minimized at portion 46. If toner cloud is produced at void portion 46, moreover, it can be prevented from touching nondeveloping region C of photosensitive drum 2 by screening member 48, which is provided on the drum side of the void portion. Thus, toner T can be prevented from sticking to unexposed portions of the electrostatic latent image on drum 2, so that the resulting image is free from fog.

Since upper and lower end edges 58 and 60 of screening member 48 are in contact with developer G transported by means of upper and lower magnet rollers 34 and 36, toner cloud can be prevented from flowing out through void portion 46. At the same time, uncharged or undercharged particles of toner T can be scraped off.

It is to be desired that the distances between the surface of photosensitive drum 2 and screening member 48 fixed to first face 52 of support member 50, between second face 54 of member 50 and the surface of upper magnet roller 34, and between third face 56 of member 50 and the surface of lower magnet roller 36 should be minimized. By doing this, convection of toner cloud can be re trained.

What is claimed is:

1. A developing apparatus for developing a latent image on an image carrier, comprising:

first means for supplying a developing agent to the latent image on the image carrier, for developing the latent image;

second means for supplying a developing agent to the latent image on the image carrier, for developing the latent image; and means, disposed in a region surrounded by the image carrier and the first and second means, for isolating the image carrier from those portions of the first and second means which face said surrounded region.

2. The developing apparatus according to claim 1, wherein said isolation means includes a sheet-like screening member for screening that portion of said surrounded region which surrounds the image-carrier.

3. The developing apparatus according to claim 2, wherein said screening member comprises a material incapable of being negatively charged against the developing agent when coming into friction with the developing agent.

4. The developing apparatus according to claim 2, wherein said screening member comprises a material having a Young's modulus of 0.5 to 2.0 kg/mm$^2$.

5. The developing apparatus according to claim 2, wherein said screening member comprises a flexible member with a thickness of 0.05 to 2.0 mm.

6. The developing apparatus according to claim 1, wherein said first means includes a first roller for transporting the developing agent, said second means includes a second roller for transporting the developing agent, and said image carrier includes a photosensitive drum for carrying the latent image.

7. The developing apparatus according to claim 6, wherein said isolation means has a size large enough to cover the whole transverse length of the first and second developing rollers.

8. The developing apparatus according to claim 6, wherein said isolation means has at least one of a first end edge and a second end edge, said first end edge softly in contact with the developing agent transported by the first developing roller, without lowering the efficiency of transportation of the developing agent, and said second end edge softly in contact with the developing agent transported by the second developing roller, without lowering the transportation efficiency.

9. The developing apparatus according to claim 6, further comprising supporting means for supporting said screening member, said supporting means being located in said surrounded region.

10. The developing apparatus according to claim 9, wherein said supporting means has a first face opposed to the photosensitive drum, a second face opposed to the first developing roller, and a third face opposed to the second developing roller.

11. The developing apparatus according to claim 10, wherein said first, second, and third faces are shaped so as to extend along the peripheral surfaces of the photosensitive drum, the first roller, and the second roller, respectively.

12. The developing apparatus according to claim 10, wherein said isolation means is fixed to the first face.

13. The developing apparatus according to claim 1, wherein said image carrier includes a photosensitive drum having its surface adapted to move from the side of the first means to the side of the second means, said first means includes a first roller adapted to rotate in the same direction as the photosensitive drum, and said second means includes a second roller adapted to rotate in the direction opposite to the rotating direction of the photosensitive drum.

* * * * *